US009177740B2

(12) United States Patent
Mantilla et al.

(10) Patent No.: US 9,177,740 B2
(45) Date of Patent: Nov. 3, 2015

(54) GAS-INSULATED HIGH-VOLTAGE SWITCH FOR INTERRUPTION OF LARGE CURRENTS

(71) Applicant: ABB TECHNOLOGY AG, Zurich (CH)

(72) Inventors: Javier Mantilla, Baden (CH); Mathias-Dominic Buergler, Baden-Dättwil (CH); Nicola Gariboldi, Nussbaumen (CH); Stephan Grob, Baden (CH)

(73) Assignee: ABB TECHNOLOGY AG, Zurich (CH)

( * ) Notice: Subject to any disclaimer, the term of this patent is extended or adjusted under 35 U.S.C. 154(b) by 297 days.

(21) Appl. No.: 13/849,686

(22) Filed: Mar. 25, 2013

(65) Prior Publication Data

US 2013/0213936 A1 Aug. 22, 2013

Related U.S. Application Data

(63) Continuation of application No. PCT/EP2011/065094, filed on Sep. 1, 2011.

(30) Foreign Application Priority Data

Sep. 24, 2010 (EP) ..... 10179319

(51) Int. Cl.

| | |
|---|---|
| ***H01H 33/88*** | (2006.01) |
| ***H01H 33/02*** | (2006.01) |
| ***H01H 1/00*** | (2006.01) |
| *H01H 71/04* | (2006.01) |

(52) U.S. Cl.

CPC ..... *H01H 33/027* (2013.01); *H01H 1/0015* (2013.01); *H01H 33/88* (2013.01); *H01H 2071/044* (2013.01)

(58) Field of Classification Search

CPC ... H01H 33/027; H01H 33/88; H01H 33/882; H01H 33/884; H01H 33/886; H01H 33/888; H01H 33/902; H01H 1/00; H01H 1/0015; H01H 33/903; H01H 33/904; H01H 33/905

USPC ..... 218/3, 7, 13, 78, 84, 43–55, 154

See application file for complete search history.

(56) References Cited

U.S. PATENT DOCUMENTS

| | | | | |
|---|---|---|---|---|
| 6,002,560 | A | 12/1999 | Nguyen et al. | |
| 6,437,273 | B2 * | 8/2002 | Stechbarth et al. | 218/3 |
| 7,098,418 | B1 | 8/2006 | Yamada et al. | |
| 8,269,126 | B2 * | 9/2012 | Kanazawa et al. | 218/53 |

(Continued)

FOREIGN PATENT DOCUMENTS

| | | |
|---|---|---|
| CN | 1038188 | 12/1989 |
| DE | 20 2007 018 709 U1 | 3/2009 |
| FR | 2 346 837 A1 | 10/1977 |

OTHER PUBLICATIONS

International Search Report (PCT/ISA/210) issued on Nov. 29, 2011, by the Europeane Patent Office as the International Searching Authority for International Application No. PCT/EP2011/065094.

(Continued)

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

A gas-insulated high-voltage switch for the interruption of large currents includes a housing, a contact arrangement which is arranged in the housing and has two switching pieces which can be moved relative to one another along an axis. Each switching piece has a rated current contact and an arcing contact. The switch includes a drive which acts on a first of the two switching pieces. The switch includes a device configured to detect and indicate the contact wear of the two arcing contacts caused by the action of the arc. The device has an indicator arranged outside the housing. In the switch, the remaining life which is determined by the contact wear of the arcing contacts is detected and indicated by a simple mechanical mechanism. The device has a transmission mechanism which is fed through the housing in a gas-tight manner and a drive member coupled to the operating element.

9 Claims, 5 Drawing Sheets

(56) References Cited

U.S. PATENT DOCUMENTS

| | | | |
|---|---|---|---|
| 2008/0217297 | A1 | 9/2008 | Kanazawa et al. |
| 2010/0326959 | A1 | 12/2010 | Kanazawa et al. |

OTHER PUBLICATIONS

Written Opinion (PCT/ISA/237) issued on Nov. 29, 2011, by the Europeane Patent Office as the International Searching Authority for International Application No. PCT/EP2011/065094.

International Preliminary Report on Patentability (PCT/IPEA/409) issued on Nov. 7, 2012, by the Japanese Patent Office for International Application No. PCT/EP2011/065094.

Euroean Search Report issued on Feb. 9, 2011.

Notification of Transmittal of Translation of the International Preliminary Report on Patentability Report (Forms PCT/IB/338 and PCT/IPEA/409) dated Mar. 28, 2013, issued in corresponding International Application No. PCT/EP2011/065094. (7 pages).

* cited by examiner

GAS-INSULATED HIGH-VOLTAGE SWITCH FOR INTERRUPTION OF LARGE CURRENTS

RELATED APPLICATIONS

This application claims priority as a continuation application under 35 U.S.C. §120 to PCT/EP2011/065094, which was filed as an International Application on Sep. 1, 2011 designating the U.S., and which claims priority to European Application 10179319.8 filed on Sep. 24, 2010. The entire contents of these applications are hereby incorporated by reference in their entireties.

FIELD

The present disclosure relates to a gas-insulated high-voltage switch for the interruption of large currents.

BACKGROUND INFORMATION

Switches of the kind mentioned above are designed in the form of circuit breakers and have a rated current carrying capacity of at least several kA in the voltage range of more than several kV. In general, these switches are used as generator switches and therefore contain a contact arrangement which can be loaded with high rated currents and has two switching pieces—in each case containing a rated current contact and an arcing contact. A current path containing the rated current contacts is used to carry the predominant part of the operating current, whereas a power path, which is connected in parallel with the rated current path and contains the arcing contacts, only carries the whole current for a short time when interrupting a generally extremely powerful current. The arcing contacts then draw a powerful switching arc, which causes a greater or lesser degree of contact wear depending on the amount of work performed by it. It is important for the switching behavior of these switches that, when switching off, the arcing contacts separate within a certain time interval after the rated current contacts and, when switching on, close within this time interval before the rated current contacts. However, the length of the arcing contacts along an axis, along which the two switching pieces move relative to one another during a switching operation, changes as a result of the contact wear. In the case of severe contact wear, the time can be less than this time interval and accordingly the switching capability of the switch can be greatly impaired.

A switch of the kind mentioned in the introduction is disclosed in DE U 20 2007 018 709 U1. With this switch, the contact wear of the arcing contacts is determined with the help of sensors and a signal measuring unit while the switch is operating, that is to say when the contact arrangement is closed, and the user of the switch is informed of the current condition of the arcing contacts caused by the contact wear by an indicator which is connected to the signal measuring unit. If the time is less than a time interval which corresponds to a critical value of the reduced length of the arcing contacts due to wear, the user is informed by means of a visual, in particular colored, and/or an audible signal that the remaining life of the switch is only relatively short.

Vacuum switches which in each case have a contact arrangement located in an evacuated vessel are disclosed in U.S. Pat. No. 6,002,560 A and U.S. Pat. No. 7,098,418 B1. The contact arrangement has two contacts which butt against one another head-to-head when the contact arrangement is closed. A moving contact of the two contacts is rigidly connected to a rod, which is arranged outside the vessel, of a transmission mechanism which transmits drive force. With these switches, while the switch is in operation, the contact wear is indicated in each case with the help of an indicator which is fixed directly to the rod or to an arm of a two-arm lever of the transmission mechanism which is hinged to the drive bar. Since the two contacts butt against one another head-to-head at the points which are at risk of wear, the indicator shows the sum of the length change of the two contacts and therefore the remaining life of the switch as a function of the position of the transmission mechanism which transmits drive force to the contact arrangement.

In US20080217297 A, in order to determine the contact wear for a circuit breaker having a rated current contact and wearing contact system, it is proposed to measure the concentration of a volatile marker substance. With this switch, the marker substance is contained in the stationary wearing contact pin and, on release, can be detected by a gas chromatograph. The concentration of the marker substance is said to behave proportionally to the wear on the contacts.

A circuit breaker having a single contact arrangement and a device for detecting the wear of the contacts is disclosed in FR2346837. The contact arrangement has two contacts which butt against one another head-to-head when the contact arrangement is closed. One of the two contact pieces is movable and is driven by the switch drive via levers. The switch drive also moves a lever which is connected directly to the drive and is located outside the housing and which reproduces the angle of rotation of the drive axis and therefore indirectly indicates the position of the moving contact piece outside the housing. This makes a detection of the wear of the contacts, which is mechanically coupled to the switch drive and is therefore dependent on the functional condition of the drive, possible.

SUMMARY

An exemplary embodiment of the present disclosure provides a gas-insulated high-voltage switch for the interruption of large currents. The exemplary switch includes a housing filled with insulating gas, and a contact arrangement which is arranged in the housing and has two switching pieces which are configured to be moved relative to one another along an axis. Each of the switching pieces has a rated current contact and an arcing contact, respectively. The exemplary switch also includes a drive configured to act on a first of the two switching pieces, and a device configured to detect and indicate a contact wear of the two arcing contacts of the two switching pieces caused by an action of an arc. The device includes an indicator arranged outside the housing. When the contact arrangement is closed, the two arcing contacts butt against one another head-to-head at a free end while forming an abutment point. The arcing contact of a second one of the switching pieces is mounted to be moved axially against the action of a pre-loaded spring and carry an axially aligned operating element at the end thereof facing away from the abutment point. The device includes a transmission mechanism which is fed through the housing in a gas-tight manner and a drive member which is coupled to the operating element.

BRIEF DESCRIPTION OF THE DRAWINGS

Additional refinements, advantages and features of the present disclosure are described in more detail below with reference to exemplary embodiments illustrated in the drawings, in which.

Figure 1:
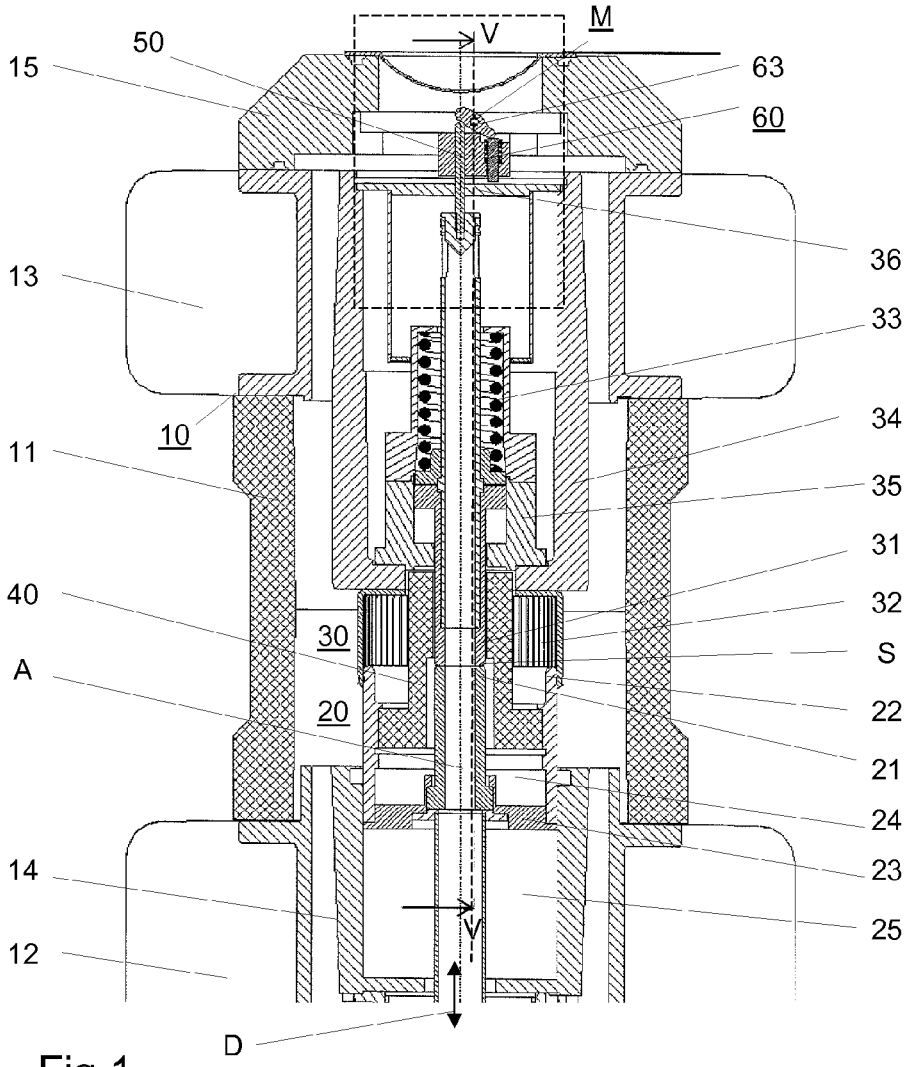
FIG. 1 shows a plan view of a section along an axis A through an exemplary embodiment of a high-voltage switch according to the present disclosure, in which the contact arrangement of the switch is closed.
Figure 2:
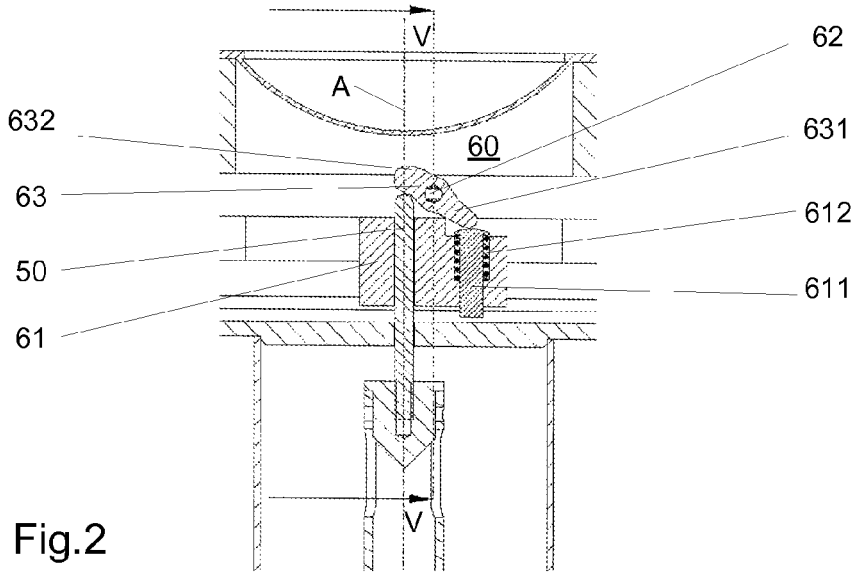
FIG. 2 shows an enlargement of an outlined part of the switch according to FIG. 1.

The reference numbers used in the drawings and their meaning are listed in summary in the list of references. Basically, the same or similarly functioning parts are designated by the same or similar reference numbers. Parts which are not essential for understanding the disclosure are sometimes not shown. The exemplary embodiments described are examples of the subject matter of the disclosure and have no restrictive effect.

DETAILED DESCRIPTION

Exemplary embodiments of the present disclosure provide a gas-insulated switch for the interruption of large currents. In accordance with the gas-insulated switch of the present disclosure, the remaining life which is determined by the contact wear of the arcing contacts is detected and indicated by simple mechanical means.

The gas-insulated high-voltage switch according to the present disclosure may be used for the interruption of large currents. The gas-insulated high-voltage switch of the present disclosure includes a housing filled with insulating gas, a contact arrangement which is arranged in the housing and has two switching pieces which can be moved relative to one another along an axis and each have a rated current contact and an arcing contact, a drive which acts on a first of the two switching pieces, and a device for the detection and indication of the contact wear of the two arcing contacts caused by the action of the arc. The detection and indication device includes an indicator arranged outside the housing. With this switch, when the contact arrangement is closed, the two arcing contacts butt against one another head-to-head at a free end in each case while forming an abutment point, and the arcing contact of the second switching piece is mounted so that it can be moved axially against the action of a pre-loaded spring and carries an axially aligned operating element at the end thereof facing away from the abutment point. The detection and indication device includes a transmission mechanism which is fed through the housing in a gas-tight manner, and a drive member which is coupled to the operating element.

In accordance with an exemplary embodiment of the switch according to the present disclosure, when the contact arrangement is closed, for example, under operating conditions, a shortening of the arcing contacts caused by contact wear is therefore detected by simple mechanical means independently of the switch drive, and this shortening and therefore also the contact wear and remaining life of the switch, respectively, are indicated outside the housing with the help of a suitably arranged and designed transmission mechanism. As this switch is a switch with a rated current path and a power path connected in parallel therewith, with which it is provided for the switching behavior that, when switching off, the arcing contacts separate within a certain time interval after the rated current contacts open and, when switching on, close within this time interval before the rated current contacts, the operating reliability of the switch is increased in a simple and cost-effective manner.

In accordance with an exemplary embodiment of the switch, the transmission mechanism can include a shaft which is fed through the wall of the housing in a gas-tight manner. An end of the shaft which lies within the housing is connected to the drive member, and an end of the shaft which lies outside the housing is connected to an indicating element of the indicator. Such a switch can be produced easily and economically and at the same time is distinguished by good gas-tightness.

The indication of the remaining life of the switch is simplified when the drive member is subjected to a reset force and is supported on the operating element against the reset force when the contact arrangement is closed.

In accordance with an exemplary embodiment, the drive element is designed as a two-arm lever rigidly connected to the shaft. The first arm of the lever is subjected to the reset force, and the second arm of the lever is supported on the operating element when the contact arrangement is closed and on a fixed stop when the contact arrangement is open. The detection and indication device of the switch is therefore in a clearly defined position both when the contact arrangement is closed and when it is open. This enables the detection and indication device to be easily calibrated and increases the quality and reliability of the values of the contact wear and remaining life respectively ascertained by a shortening of the contacts. In an advantageous manner from a manufacturing point of view, in this embodiment of the switch, the transmission mechanism can have a bearing block arranged in the housing, in which bearing block the operating element and a sliding body which transmits the reset force are mounted so that they can be moved axially, and in which the shaft is pivotably mounted.

In accordance with an exemplary embodiment of the switch which is simple and easy-to-produce, the drive member can be designed as a single-arm lever which is subjected to the reset force, the arm of which is supported on the operating element when the contact arrangement is closed and on a fixed stop when the contact arrangement is open. The reset force can be achieved with the help of a yoke spring which is supported on the shaft and which is retained on the housing. In an advantageous manner from a manufacturing point of view, this embodiment of the switch can also have a bearing block which is integrated into the transmission mechanism and arranged in the housing and in which the shaft is pivotably mounted and—in contrast to the embodiment with the two-arm lever—only the operating element is mounted so that it can be moved axially.

The exemplary embodiments of the high-voltage switch according to the present disclosure shown in the drawings are in each case in the form of generator switches and may be designed for a rated voltage of 24 kV, a rated current of 6.3 kA, a permissible short-circuit current of 63 kA and a rated frequency of 50/60 Hertz, for example. The exemplary embodiments have a housing 10 which is filled with an insulating gas which has arc-extinguishing properties, for example, based on sulfur hexafluoride and/or nitrogen and/or carbon dioxide, generally with a pressure of up to a few bar. The housing 10 has a hollow cylindrical insulator 11 and two metal hollow bodies 12, 13, which each serve as a power connector and between which the insulator 11 is flanged in a gas-tight manner. A contact arrangement, which is electrically conductively connected to the power connectors 12, 13 and which has two switching pieces 20 and 30 which can be moved relative to one another along an axis A, is provided in the housing 10. The switching piece 20 is connected to a drive and—as specified by a double arrow D—is guided upwards along the axis A on closing and downwards along the axis A on opening.

The switching piece 20 has a tubular arcing contact 21 and a rated current contact 22 which encompasses this contact at a distance therefrom in an axially symmetrical arrangement. The switching piece 30 contains an arcing contact 31, which is likewise tubular, and a rated current contact 32 which encompasses the arcing contact 31 at a distance therefrom in an axially symmetrical arrangement. The arcing contact 31 is mounted opposite the rated current contact 32 so that it can be moved along the axis A and, when the switch is closed, is supported by its arc-resistant free end on the likewise arc-resistant free end of the arcing contact 21 with the help of a pre-loaded spring 33 while forming an adequate contact force and an abutment point S.

In the case of the switching piece 20, the arcing contact 21 and the rated current contact 22 are electrically conductively connected by means of a radially extending wall 23. An insulating nozzle 40, which may contain polytetrafluoroethylene (PTFE) and which is arranged between the arcing contact 21 and the rated current contact 22 and extends beyond the free ends thereof, is fixed to the switching piece 20. The arcing contact 21 and the rated current contact 22 are electrically conductively connected by means of a radially extending wall 23 and, together with the wall 23 and the nozzle 40, border a heating volume 24 which serves to accommodate compressed arc gas. When the switch opens, this extinguishing gas is produced by a switching arc which has its foot on the arcing contacts 21, 31 which separate from one another on opening, and flows from an arcing zone, which accommodates the arc and is bordered by the contacts 21, 31 and the insulating nozzle 40, into the heating volume 24. The switching piece 20 is guided in a fixed, metal hollow cylinder 14 which, together with the wall, borders a compression chamber 25 of a piston-cylinder compression device. When the switch opens, insulating gas in the compression chamber 25 is compressed with the help of the switching piece 20 which is then guided downwards and acts as a piston. If the gas pressure in the heating volume 24 is less than in the compression chamber 25, the compressed insulating gas is fed out of the compression chamber 25 into the heating volume 24.

The switching piece 30 has a contact carrier 34 designed in the form of a pot. At the end thereof which acts as the edge of the pot, the contact carrier 34 is integrated into the hollow body 13 which serves as a power connector. A hollow cylinder 35, which serves to axially guide the arcing contact 31 and in which the spring 33 is mounted, is arranged at the bottom of the contact carrier 34. At its top end, the arcing contact 31 carries an axially aligned operating element 50, which is in the form of a rod and is fed through a shield 36 into an upper section 15 of the housing 10 in the form of a metal cover.

Figure 5:
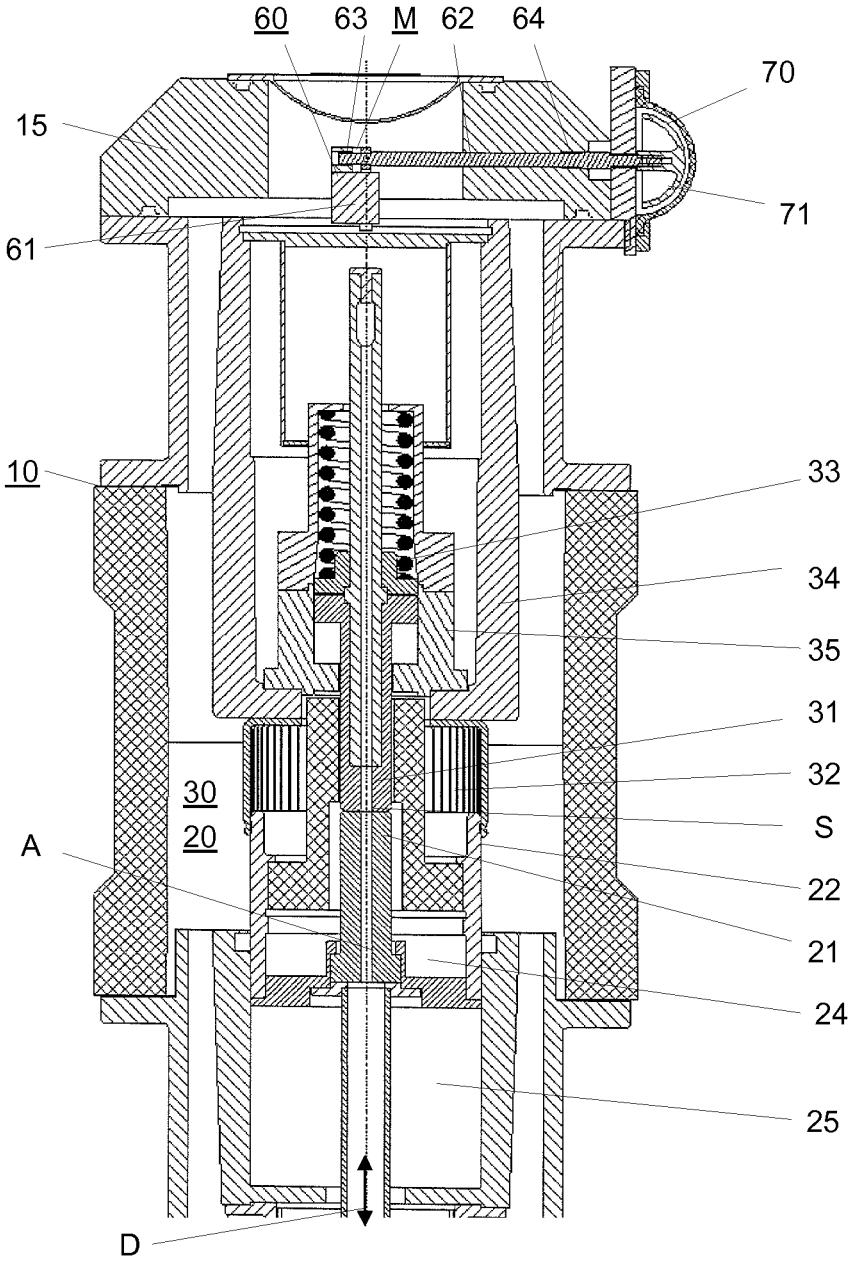
FIG. 5 shows a plan view in the direction of the arrow on a section along V-V through the switch according to FIG. 1.
Figure 6:
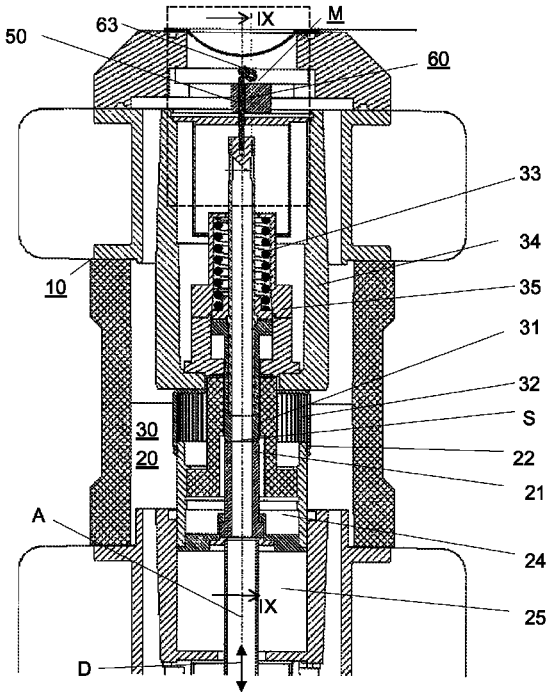
FIG. 6 shows a plan view of a section along the axis A through an exemplary embodiment of a high-voltage switch according to the present disclosure, in which the contact arrangement of the switch is closed.
Figure 9:
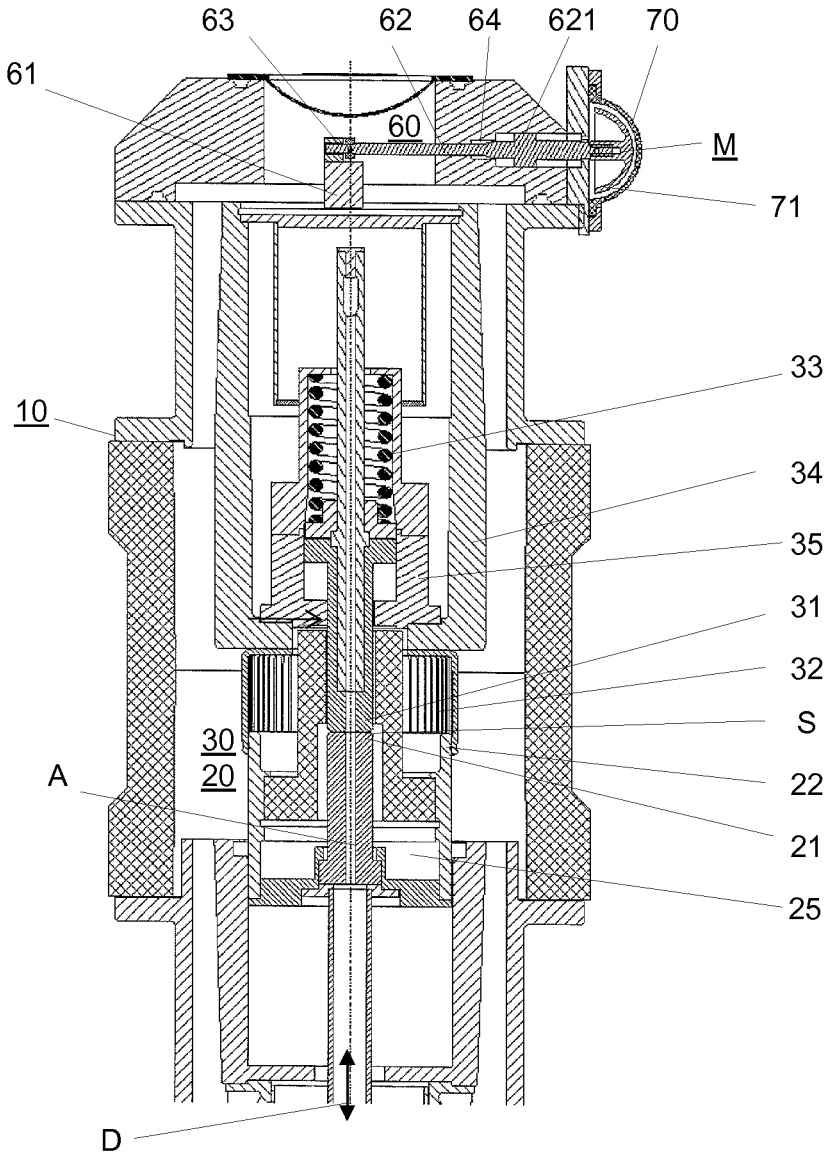
FIG. 9 shows a plan view in the direction of the arrow on a section along IX-IX through the switch according to FIG. 6.

The operating element 50 acts together with a device M which detects and indicates the current condition of the arcing contacts 21, 31 determined by the position of the operating element 50. At the same time, the position of the operating element 50 serves as a measure of the contact wear caused by the eroding and corroding action of the switching arc. The detection and indication device M contains a transmission mechanism 60, which can be activated by the operating element 50, and an indicator 70, which is mechanically actuated by the transmission mechanism and is arranged outside the housing 10 and the housing section 15, respectively (shown in FIGS. 5 and 9).

It can be seen particularly clearly from FIGS. 2, 4, 7 and 8 that the housing section 15 carries an immovably retained bearing block 61 of the transmission mechanism 60. On the one hand, this bearing block 61 serves to guide the operating element 50 which can be moved along the axis A and, on the other hand, to mount a shaft 62 of the transmission mechanism 60 which can be seen, in particular, from FIGS. 5 and 9. Further, the transmission mechanism contains a drive member 63 which is rigidly connected to the shaft 62. It can also be seen from FIGS. 5 and 9 that the shaft 62 for its part is fed in a gas-tight manner with the help of a seal 64 through the housing section 15 to the outside, where it is directly connected, for example, by means of a screw connection, or indirectly connected, for example, by means of a further transmission mechanism, to a moving indicating element 71 of the indicator 70. Since the shaft 62 is only pivoted and not subjected to thrust, the seal 64 can easily be realized with the help of one or more commercially available sealing rings and a high degree of gas-tightness can therefore easily be achieved.

When the switch is closed, the current to be interrupted is fed predominantly from connector 12 via the hollow cylinder 14, a sliding contact and the rated current contacts 22, 32 to the hollow body 13 which contains the contact carrier 34 and serves as a power connector. A smaller part of the current to be interrupted flows to the connector 13 in a current path which is arranged in parallel with the rated current contacts 22, 32 and contains the connecting wall 23, the arcing contacts 21, 31, a sliding contact and the hollow cylinder 35. The pre-loaded spring 33 provides the necessary contact force at the abutment point S.

Figure 3:
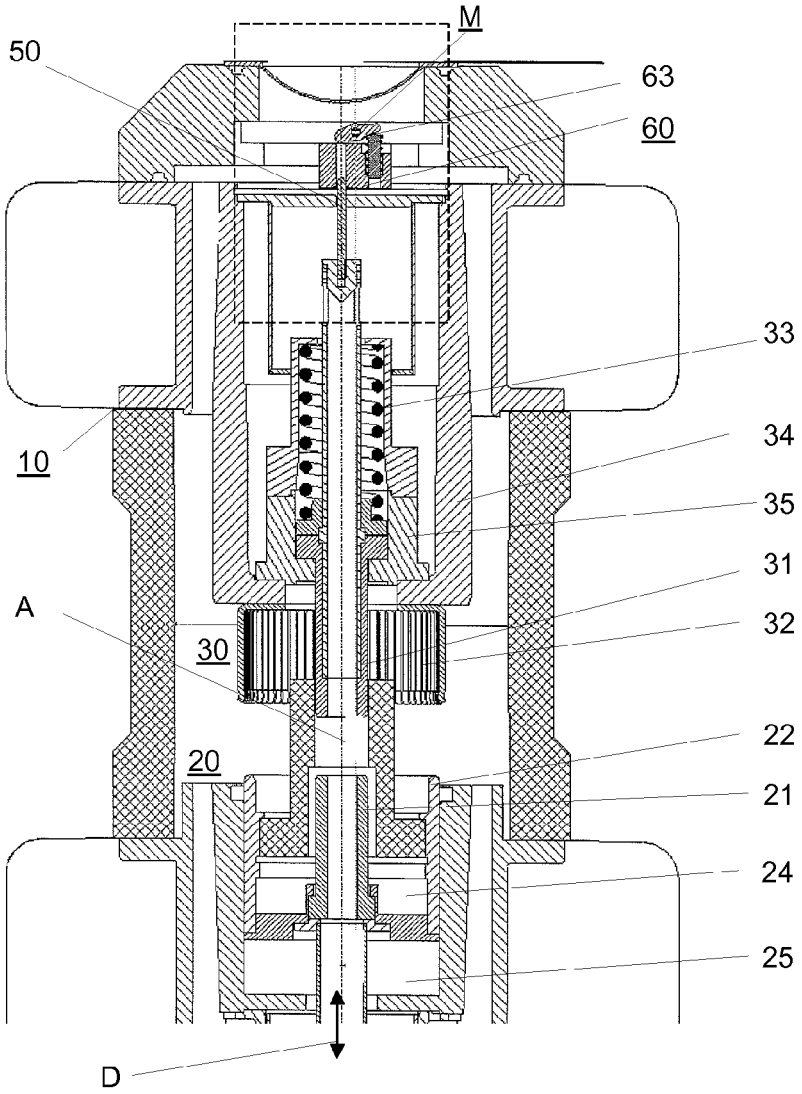
FIG. 3 shows a plan view according to FIG. 1, in which the contact arrangement of the switch is open.
Figure 4:
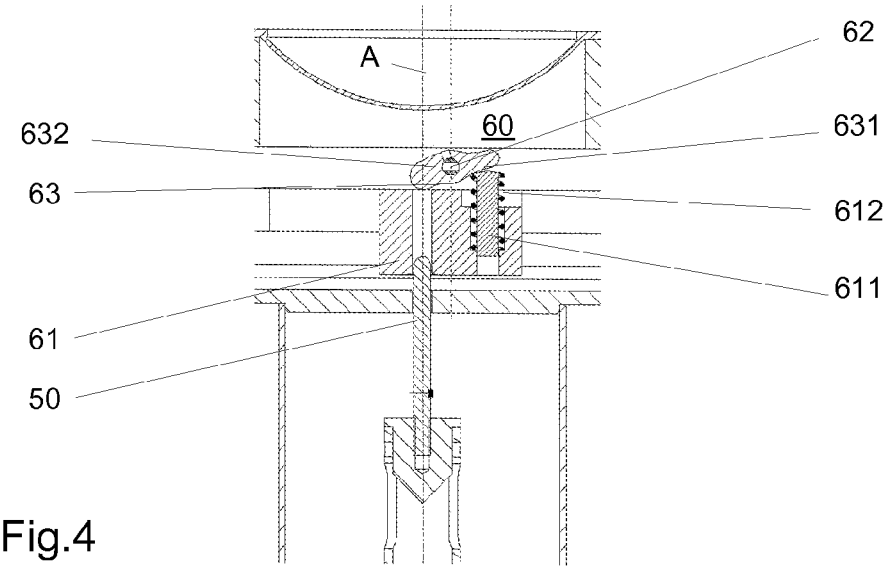
FIG. 4 shows an enlargement of an outlined part of the switch according to FIG. 3.

When a short-circuit current is switched off, the drive D guides the switching piece 20 downwards. In doing so, the arcing contact 31, which in the switched-on position of the switch (FIGS. 1, 2, 5, 6, 7 and 9) is supported on the arcing contact 21, is caused to follow by the pre-loaded spring 33 while maintaining the required contact force. During the following-movement, the rated current contacts 22, 32 separate and the current commutates completely into the parallel connected current path which, instead of the rated current contacts, now contains the connecting wall 23, the arcing contacts 21, 31, a sliding contact and the hollow cylinder 35. As soon as the following-movement is complete, the arcing contacts 21, 31 separate and form a switching arc between their opposing free ends. This switching arc forms hot, pressurized gas which expands into the heating volume 24. When the current to be switched off approaches a zero crossover, the gas stored in the heating volume 24—possibly assisted by compressed insulating gas from the compression chamber 25—blows out the arc, which causes an interruption of the current. The switch finally moves into the switched-off position (FIGS. 3, 4 and 8).

The high energy of the switching arc erodes and corrodes the arcing contacts 21, 31 and thus reduces the length of the arcing contacts by contact wear. The pre-loaded spring 33 guides the arcing contact 31 downwards, thus compensating the reduced length of the contacts 21, 31. Accordingly the arcing contact 31 and therefore also the operating element 50 change their position downwards in the face of the switch-off operation. If the switch is closed again after the current is interrupted, then the changed position of the operating element 50, which corresponds to the sum of the loss of length on both arcing contacts 21, 31 which occurs due to contact wear, can be read off on the indicator 70. On the one hand, by suitable sizing, arrangement and/or design of the operating element 50 and of the transmission mechanism 60, the current condition of the arcing contacts 21, 31 can be indicated and, on the other, also calibrated. A suitably calibrated detection and indication device M therefore gives a warning signal whenever the operating element 50 moves too far downwards. As the free ends of the arcing contacts 21, 31 are then positioned so unfavorably with respect to the free ends of the rated current contacts 22, 32 during a switching operation that, on switching off, the arcing contacts do not separate within a certain time interval after the rated current contacts open and, when switching on, do not close within this time interval before the rated current contacts close, this avoids a faulty switching operation and at the same time informs the user of the remaining life of the switch and its need for maintenance respectively.

With the exemplary embodiments of the switch according to FIGS. 1 to 5, the drive member is designed as a two-arm lever. A first arm of the lever, designated in FIGS. 2 and 4 by the reference 631, is supported on a sliding body 611 which is guided in the bearing block 61 and acted upon by a reset force with the help of a pre-loaded spring 612. When the contact arrangement is closed (FIG. 2), the second arm of the lever, designated by the reference 632, is supported on the end of the operating element 50 which faces away from the abutment point and projects from the bearing block 61, and, when the contact arrangement is open (FIG. 4), on the bearing block 61 which then acts as a stop. In each case, the reset force transmitted to the arm 631 via the sliding body 611 holds the lever arm 632 in a defined position both when the contact arrangement is open and when it is closed. The current position of the arcing contact 31 and of the operating element 50 respectively and therefore the wear on the arcing contacts 21, 31 which can be detected by reduction in length, is shown purely by mechanical means on the indicator 70 by means of the shaft 62 and the indicating element 71 (FIG. 5) which is mechanically connected to the shaft.

Figure 7:
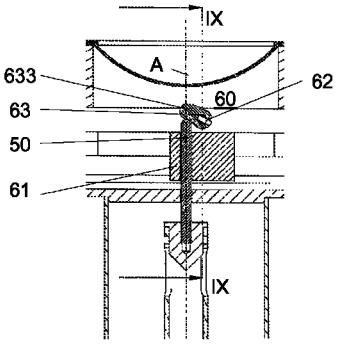
FIG. 7 shows an enlargement of an outlined part of the switch according to FIG. 6.
Figure 8:
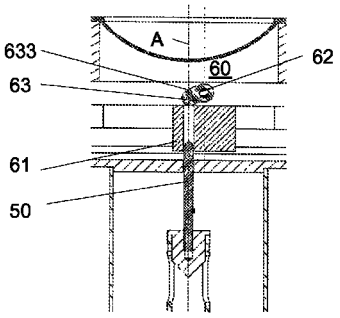
FIG. 8 shows an enlargement of an outlined part of the switch according to FIG. 6, in which the contact arrangement of the switch is open.

With the exemplary embodiments of the switch according to FIGS. 6 to 9, the drive member is designed as a single-arm lever. A yolk spring 621 (FIG. 9) supported on the shaft 62 applies to the shaft a torque which acts in an anticlockwise direction (FIGS. 7 and 8). When the contact arrangement is closed (FIG. 7), the single arm of the lever, designated by the reference 633, is supported on the end of the operating element 50 which faces away from the abutment point and projects from the bearing block 61, and, when the contact arrangement is open (FIG. 8), on the bearing block 61 which then acts as a stop. In each case, both in the switched-on and in the switched-off state, the force transmitted from the pre-loaded spring 621 to the arm 633 via the shaft 62 holds the arm in a defined position, in which the current position of the operating element 50 and therefore the current condition of the arcing contacts 21, 31 are shown purely by mechanical means on the indicator 70 by means of the shaft 62 and the indicating element 71 which is mechanically connected to the shaft.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCES

10 Housing
11 Insulator
12, 13 Hollow body, power connectors
14 Hollow cylinder
15 Housing section
20 Switching piece
21 Arcing contact
22 Rated current contact
23 Connecting wall
24 Heating volume
25 Compression chamber
30 Switching piece
31 Arcing contact
32 Rated current contact
33 Spring
34 Contact carrier
35 Hollow cylinder
36 Shield
40 Insulating nozzle
50 Operating element, rod
60 Transmission mechanism
61 Bearing block
611 Sliding body
612 Compression spring
62 Shaft
621 Yoke spring
63 Drive member
631, 632 Lever arms
64 Seal
70 Indicator
71 Indicating element
A Axis
D Drive
M Detection and indication device
S Abutment point

What is claimed is:

1. A gas-insulated high-voltage switch for the interruption of large currents, the switch comprising:

a housing filled with insulating gas;

a contact arrangement which is arranged in the housing and has two switching pieces which are configured to be moved relative to one another along an axis, each of the switching pieces having a rated current contact and an arcing contact, respectively;

a drive configured to act on a first of the two switching pieces; and a device configured to detect and indicate a contact wear of the two arcing contacts of the two switching pieces caused by an action of an arc, the device including an indicator arranged outside the housing, wherein, when the contact arrangement is closed, the two arcing contacts butt against one another head-to-head at a free end while forming an abutment point, wherein the arcing contact of a second one of the switching pieces is mounted to be moved axially against the action of a pre-loaded spring and carry an axially aligned operating element at the end thereof facing away from the abutment point, and wherein the device includes a transmission mechanism which is fed through the housing in a gas-tight manner and a drive member which is coupled to the operating element.

2. The switch as claimed in claim 1, wherein the transmission mechanism includes a shaft which is fed through a wall of the housing in a gas-tight manner, theshaft having a first end which lies within the housing and is connected to the drive member, and a second end which lies outside the housing and is connected to an indicating element of the indicator.

3. The switch as claimed in claim 2, wherein the drive member is subjected to a reset force and is supported on the operating element against the reset force when the contact arrangement is closed.

4. The switch as claimed in claim 3, wherein the drive member comprises a two-arm lever rigidly connected to the shaft, wherein a first arm of the lever is subjected to the reset force, and wherein a second arm of the lever is supported on the operating element when the contact arrangement is closed and on a fixed stop when the contact arrangement is open.

5. The switch as claimed in claim 4, wherein the transmission mechanism includes a bearing block arranged in the housing, the bearing block having mounted therein the operating element and a sliding body which transmits the reset force so that the operating element and the sliding body are configured to be moved axially, wherein the shaft is pivotably mounted in the bearing block.

6. The switch as claimed in claim 3, wherein the drive member comprises a single-arm lever which is subjected to the reset force, the arm of lever being supported on the operating element when the contact arrangement is closed and on a fixed stop when the contact arrangement is open.

7. The switch as claimed in claim 6, comprising:

a yoke spring retained on the housing, the yoke spring being supported on the shaft and configured to produce the reset force.

8. The switch as claimed in claim 6, wherein the transmission mechanism includes a bearing block arranged in the housing, the bearing block having the operating element mounted therein so that the operating element is configured to be moved axially, and wherein the shaft is pivotably mounted in the bearing block.

9. The switch as claimed in claim 1, wherein the arcing contact of the second one of the switching pieces is mounted to be moved in the housing in an opposite direction to fix rated current contact of the second switching piece.

* * * * *